US005092356A

United States Patent [19]

Grot

[11] Patent Number: 5,092,356

[45] Date of Patent: Mar. 3, 1992

[54] NOZZLE SYSTEM TO SPRAY THE INSIDES OF BOTTLES

[75] Inventor: Uwe Grot, Hamburg, Fed. Rep. of Germany

[73] Assignee: Ortmann & Herbst GmbH, Hamburg, Fed. Rep. of Germany

[21] Appl. No.: 553,599

[22] Filed: Jul. 18, 1990

[30] Foreign Application Priority Data

Aug. 3, 1989 [DE] Fed. Rep. of Germany ..... 3925725

[51] Int. Cl.[5] ..... B08B 3/02

[52] U.S. Cl. ..... 134/167 R; 134/172; 134/181; 134/61; 239/248

[58] Field of Search ..... 134/166 R, 169 R, 172, 134/181, 131, 61, 198, 167 R; 118/306, 307, 323; 233/246, 248

[56] References Cited

U.S. PATENT DOCUMENTS

| | | | |
|---|---|---|---|
| 2,004,410 | 6/1935 | Houch et al. | 134/62 |
| 2,763,564 | 9/1956 | McKenzie et al. | 134/153 X |
| 2,851,383 | 9/1958 | Einhiple | 15/304 |
| 2,907,688 | 10/1959 | Payne, Jr. | 134/153 X |
| 4,080,974 | 3/1978 | Oag | 134/62 |
| 4,102,351 | 7/1978 | Wiendahl et al. | 134/180 |
| 4,423,745 | 1/1984 | Butt et al. | 134/62 |
| 4,920,997 | 5/1990 | Vetta et al. | 134/181 |

FOREIGN PATENT DOCUMENTS

| | | |
|---|---|---|
| 0134830 | 9/1983 | European Pat. Off. . |
| 2402630 | 5/1977 | Fed. Rep. of Germany . |
| 1121809 | 8/1956 | France . |

*Primary Examiner*—Frankie L. Stinson
*Attorney, Agent, or Firm*—Walter C. Farley

[57] ABSTRACT

A nozzle system for spraying the interior surfaces of bottles, has a nozzle unit with a through-bore mounted on a spout in a fluid delivery pipe. The nozzle unit is rotated about an axis of rotation in synchronization with the bottle advance. The bore through the nozzle unit is oblique to a plane perpendicular to the axis of rotation.

4 Claims, 4 Drawing Sheets

NOZZLE SYSTEM TO SPRAY THE INSIDES OF BOTTLES

This invention relates to a nozzle system for spraying and cleaning the insides of bottles, particularly those having relatively narrow necks as compared with their bodies.

BACKGROUND OF THE INVENTION

When cleaning re-usable bottles before they are filled again, these bottles are soaked in baths and are sprayed outside and especially inside at spraying stations. Even new bottles frequently are sprayed on their insides before being filled. In inside spraying, a liquid jet pointed at the inside of the bottle and is expected to reach all of its zones and rinse them. Affixed dirt is to be removed reliably if at all possible and to be rinsed out. The bottles are suspended above a nozzle array which sprays them from below so that the liquid can drain from the bottle inside after spraying.

Nozzle systems of the above kind comprise a rotationally driven nozzle unit in which the spray jet or stream follows the mouth of a moving bottle over a specified angular range. This design offers the advantage that the bottles can be continuously moved inside a bottle cleaning machine and are sprayed within the pivot range of the jet for an appreciable time. Another essential advantage is that the spray jet enters the bottle at different angles within the nozzle's pivot angle and hence impinges upon different wall zones of the bottle inside. Accordingly, there is expected to be intensive cleaning at different jet impact points.

Such nozzle designs of the initially cited kind are known in the state of the art. Illustratively, the nozzle unit pivots together with the nozzle pipe, for instance in a to-and-fro swinging motion. A design is known from the German patent 24 02 630, wherein the nozzle unit pivots relative to the nozzle pipe, opposite ends of the bore alternatingly pointing outward toward the bottle.

In the known nozzle systems of the foregoing kind, the nozzle bores are perpendicular to the axis of nozzle rotation and thereby generate a spray jet pivoting in the plane perpendicular to the axis of rotation. This entails the drawback that the jet impact points in the bottle all are located on a central plane through the axis of rotation of the bottle. During the pivoting motion of the jet, therefore, the impact points inside the bottle form a path moving up one side wall, across the center of the bottle base and down again on the other side of the bottle. There is, thus, insufficient rinsing in the lateral zones of the bottle away from that plane.

SUMMARY OF THE INVENTION

Accordingly, an object of the present invention is to improve the rinsing efficacy of a nozzle system for cleaning the inside surfaces of a bottle particularly in those zones which lie outside the center plane of the bottle.

The bore of a nozzle according to the invention is sloping relative to the pivot axis. Accordingly, the jet does not pivot in a plane as it does in the known designs but instead pivots along a shallow cone. The impact points of the pivoting jet inside the bottle therefore do not move centrally over the bottle bottom, but, depending on the magnitude of the angle of the jet slope, the locus of impact points forms a path which travels more or less upward along a curved path over the inside of the lateral bottle wall. When the angle of slope deviates only very slightly from the perpendicular, the jet impact points also may move a short distance over the bottle bottom. By adjusting the angle of slope, the cleaning efficiency may be appreciably raised in relation to the particular shape of the bottle and to its cleaning and flow problems. This follows especially because for the sloping spray of the invention, the jet, at least as regards a shallow angle of incidence, predominantly impinges on the bottle lateral walls and then flows around these walls.

Because of the angle subtended by the injected jet, that jet which continues flowing past the wall flows predominantly around the bottle along a helix which is more or less slanted relative to the bottle axis, so that very large bottle areas will be directly reached by the jets. This results in very intensive cleaning. These flow reversals change their angular positions by about 180° at the bottle bottom and therefore the whole bottle is essentially rinsed in this manner, whereas in the previously known designs—which comprise a jet pivoting in a plane—such flows against the wall can be achieved only very briefly at the beginning and end of the spraying, and then only in the center line of the bottle.

The spraying jets are provided, in accordance with one embodiment, which impinge on the bottle mutually offset by 180°. The impact points of one jet move over the side wall of one half of the bottle, and those of the other jet move symmetrically thereto over the other half of the bottle. In this manner cleaning can be improved further with only one nozzle unit.

By offsetting the jets at the mouth of the bottle, the two jets do not touch each other at their crossing point and, as a result, jet deflections are avoided.

By rotating the nozzle unit so that the direction of fluid passage through the bores occurs periodically, the advantages of the above cited German patent 24 02 630 regarding self-cleaning of the nozzle bores can be achieved. The bores should subtend the same angle to the axis of rotation at their two ends so that they provide the same jet angle in both directions of flow.

The nozzle shaft is preferably constructed so that it is parallel with the spray pipe, an arrangement which has been found advantageous from the disclosure of the German patent 24 02 630.

BRIEF DESCRIPTION OF THE DRAWINGS

The invention is shown in illustrative and schematic manner in the drawings in which.

DESCRIPTION OF THE PREFERRED EMBODIMENTS

Initially the state of the art such as shown in German patent 24 02 630 will be discussed again.

Figure 1:
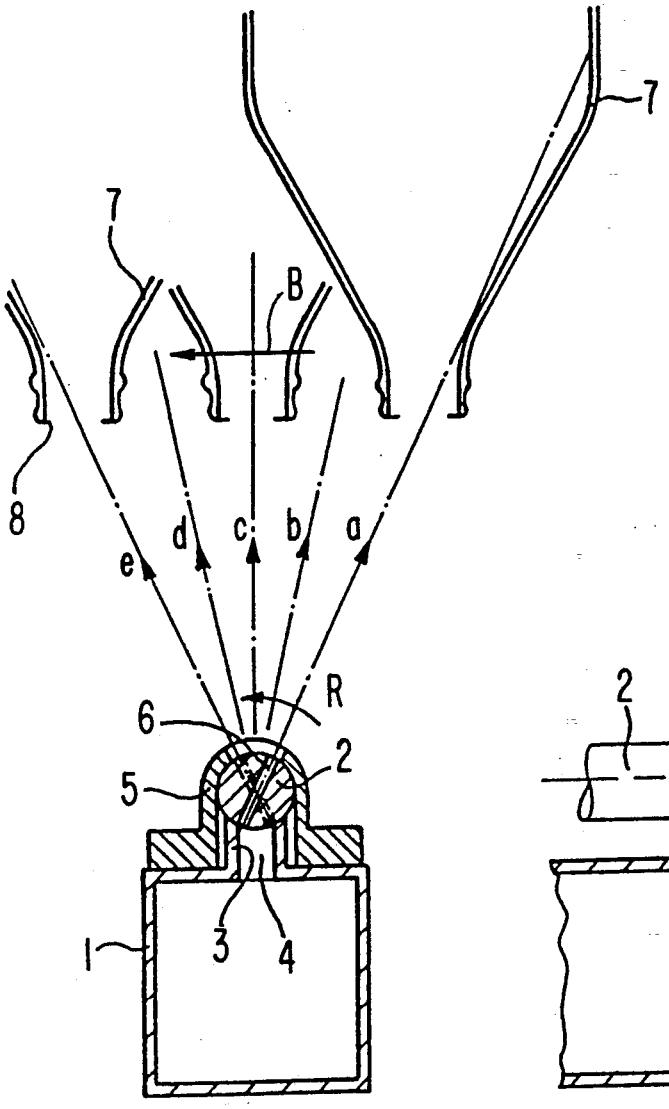
Fig. 1 (PRIOR ART)
FIG. 1 is a transverse sectional view of a prior art nozzle system with a bottle moving above the nozzle.
Figure 2:
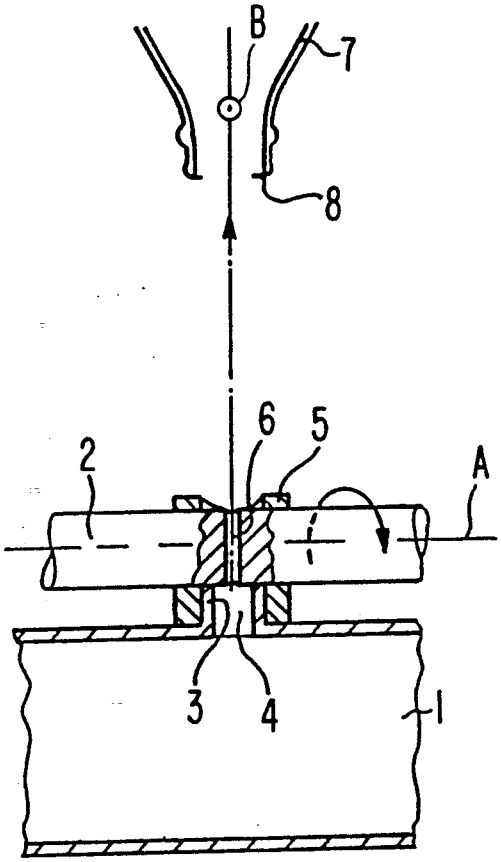
Fig. 2 (PRIOR ART)
FIG. 2 is a longitudinal sectional view of the system of FIG. 1.

FIGS. 1 and 2 show, in cross-section and in longitudinal section, a fluid delivery pipe, referred to as a spray pipe 1, with a nozzle unit designed as a nozzle shaft 2 and rotatable about the axis A. For that purpose the nozzle shaft 2 rests on the outer rim of a spout 3 shaped to accomodate the nozzle shaft. Accordingly the nozzle shaft 2 seals the aperture 4 of the spout 3. The nozzle shaft 2 is held on spout 3 by a yoke 5, the yoke having a slot 5A above aperture 4, as best seen in FIG. 1.

Nozzle shaft 2 has a bore 6 positioned above aperture 4, the bore being perpendicular to the axis of rotation A of the nozzle shaft in the manner of the state of the art. When the nozzle shaft 2 rotates about axis A, the end of the bore 6 near the spray pipe 1 communicates with the aperture 4 throughout the angular range indicated in FIG. 1 and, accordingly, cleaning liquid delivered under pressure by the spray pipe 1 discharges through bore 6 and slot 5A as a spray jet or stream which is shown in FIG. 1 by lines at several pivot angles with arrows a through e.

A bottle 7 is moved above the nozzle system in the direction of arrow B in FIG. 1. In FIG. 2 this motion is perpendicular to the plane of the drawing. The rotational drive of nozzle shaft 2 is synchronous with the advance of bottle 7. The nozzle shaft rotates in the direction shown by the arrow R in FIG. 1. When the outer end of bore 6 reaches aperture 4 of spray pipe 1, the first jet a enters the bottle at the angle shown. The last jet e, formed shortly before the closing of the bore 6 by the other side of slot 5A, enters the bottle at the opposite angle, the bottle at that time having been moved to the left correspondingly, so that the jet still may enter the mouth.

The jet produced by the nozzle system is pivoted in a plane perpendicular to the axis A of the nozzle shaft 2, that is, in FIG. 1, in the plane of the drawing.

Figure 3:
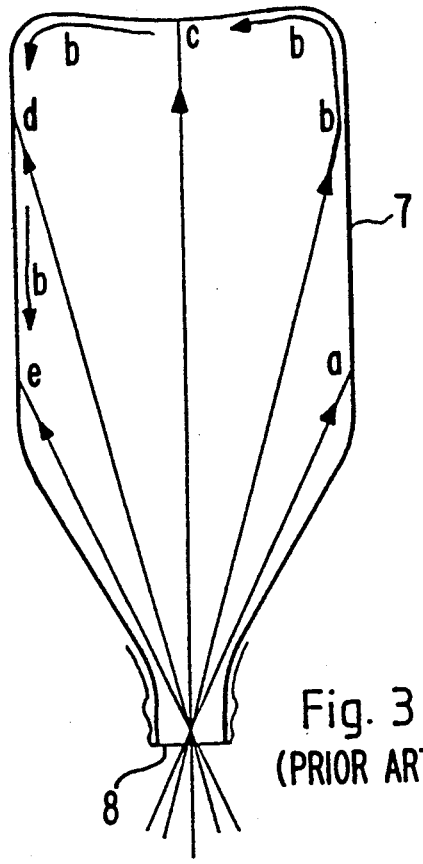
Fig. 3 (PRIOR ART)
FIG. 3 is a schematic sectional view of a bottle through the central plane thereof indicating the path of the spray jets in the prior art system.

FIG. 3 shows the bottle 7 with the first impinging jet a, the central vertically upward impinging jet c, the last jet e and two jets b and d in intermediate angular positions, all in the sectional plane of FIG. 1. It is noted that the impact points of the jets a through e first move upward along the right side wall of the bottle, as shown in FIG. 3, and then move across the bottom of the bottle and thereafter downward on the other side.

Figure 4:
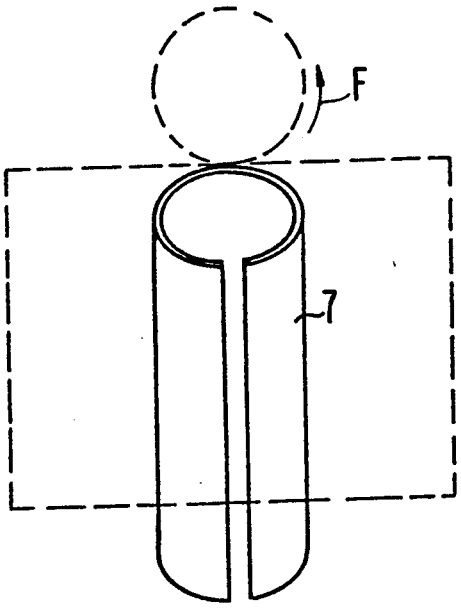
Fig. 4 (PRIOR ART)
FIG. 4 is a schematic view showing the development of the bottle surface in the plane of the drawing.

To elucidate this procedure, the bottle inside wall is developed onto the plane of the drawing. FIG. 4 shows the manner in which this development is carried out. The side wall of the bottle is cut open axially along the front and then is folded back left and right. The bottom is folded backward in the direction of the arrow F. The resulting development is shown in FIG. 5 wherein the curve K is shown, representing the path of impact points of the jets.

Figure 5:
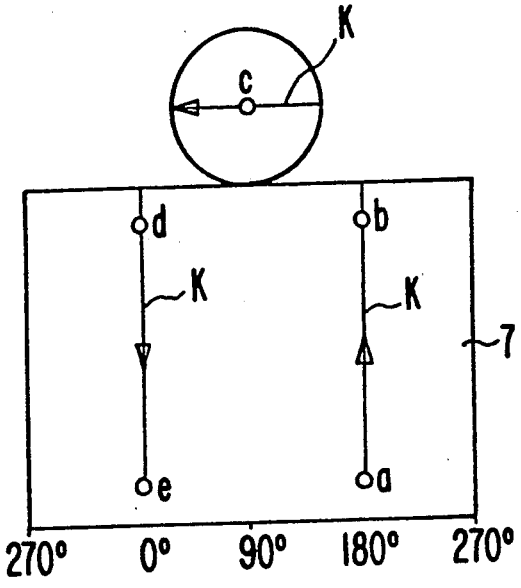
Fig. 5 (PRIOR ART)
FIG. 5 is a schematic view of the developed area showing the path of the impact points of the spray jet.

The impact points of the jets a through e shown in FIG. 3 are marked in FIG. 5. The first impact point therefore is at a, then the jet moves vertically upward along the bottle side wall through b as far as the bottle bottom which it crosses centrally, the jet c impinging at the bottom center. Thereafter the jet stream passes through impact points d through e moving down the other side wall. FIG. 5 shows at the bottom the angular positions from 0° to 360° of the bottle surface relative to the bottle axis. The bottle center plane in which it is moved and which is also in the plane of the drawing according to FIGS. 1 and 3 passes through 0° and 180° as indicated in FIG. 3. The 0° position corresponds to that line of the bottle surface which is forward in the direction of advance of FIG. 1.

In summary, the following applies to the state of the art:

The bore 6 is perpendicular to the axis of rotation A of the nozzle shaft 2. The generated spray jet a through e therefore pivots in the plane perpendicular to the axis of rotation A, that is, in the plane of the drawing of FIGS. 1 and 3, and also in the central plane of the bottle 7 which as shown by FIG. 5 passes through 0° and 180°.

As shown by FIG. 3, a jet impacting the bottom, for instance the middle jet c, essentially impinges perpendicularly on the bottle surface from which it is then reflected. However, the more valuable jets for purposes of cleaning are those impinging on the side walls. This will be explained now in relation to jet b. This jet b impinges at a relatively shallow angle on the side wall along which it moves to arrive and pass the bottom and then, still against the wall, moves down along the other side. As a result large areas of the bottle wall touched by this jet are cleaned intensively. However, the state of the art still entails the drawback that these areas against the wall are only present at the bottle center plane, that is on curve K shown in FIG. 5. Intermediate wall areas are not touched, or only insufficiently, by laterally deviating jets.

The invention is elucidated in FIGS. 6 through 12 by means of three illustrative embodiments, namely by means of a spray-pipe design with nozzle shaft and bottles moving above in the manner of the design of FIGS. 1 and 2 and completely identical therewith except for the bore, the bore of the invention being different from bore 6 of FIGS. 1 and 2.

Figure 6:
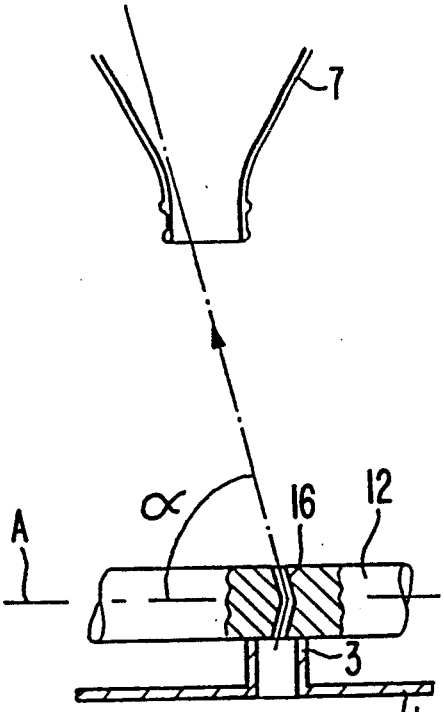
FIG. 6 is an axial sectional view of a nozzle shaft in accordance with the invention.

FIG. 6 shows a nozzle shaft 12 of the invention, in the same direction as FIG. 2. The bore 16 is formed with a bend in such a way as to issue at both apertures obliquely to the plane perpendicular to the axis of rotation A, that is, it subtends at both apertures an angle $\alpha$ with this axis A. Preferably this angle $\alpha$ shall be approximately 70° to 85°.

The spray jets issuing from the bore 16 therefore do not pivot in a plane perpendicular to the axis of rotation A but along the surface of a shallow cone having its axis of rotation A. The bottle 7 is advanced along a somewhat laterally offset path in order that the spray jet can enter the mouth 8 over the pivot angle.

Figure 7:
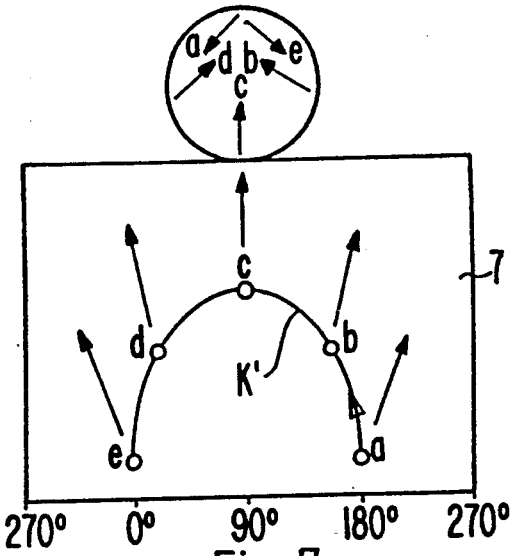
FIG. 7 is a developed view of a bottle in the manner of FIG. 5 showing the path of the jet impact points produced by the nozzle shaft of FIG. 6.

Because the spray jet is oblique, it no longer impinges on the bottle bottom, but solely on the bottle sidewall. FIG. 7 shows a development of the bottle, in the manner of FIGS. 4 and 5, and also illustrates the path of the points of impact of the spray jets produced by the nozzle shaft 12 of FIG. 6 on the interior surface of the bottle. The path of these impact points is denoted by K'.

FIG. 7 shows the jet impact points on the bottle wall for the jets a through e in the form of small circles. By means of the arrows associated with these impact points, the Figure shows how and in which direction the reflections of the jets striking the bottle wall travel from the impact points a through e along the wall. The jet beginning at the impact point c and touching the wall therefore moves upward parallel to the bottle axis and then centrally over its bottom, as denoted by another arrow c shown on the bottom. The jet starting at the impact point a and touching the wall moves obliquely upward to the right and then over the bottom in the direction the arrow shown there. The directions of motions of the remaining jets touching the wall are also shown for the remaining impact points. It follows that, except for the jet starting from c which goes vertically upward, all jets run rather obliquely, that is helically along the bottle wall. As shown by FIG. 7, when the jet is pivoted from a through e, substantially all bottle areas are covered by liquid from jets touching the wall. As shown in FIG. 3 for the jet b, these jets move touching the wall. Comparison with the jet configuration of FIG. 5 demonstrates that in the latter's jet configuration of the state of the art, all jets touching the wall move along the curve K. In the invention and as shown by FIG. 7, the jets move helically in different directions and essentially cover the entire bottle wall.

Figure 8:
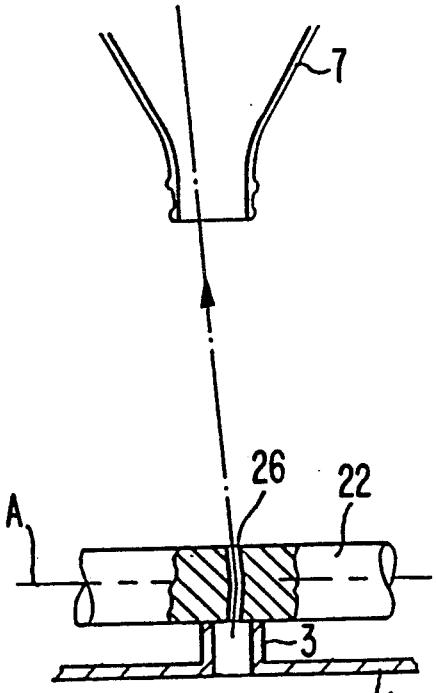
FIG. 8 is a sectional view of a nozzle shaft in accordance with the invention with a different bore angle.
Figure 9:
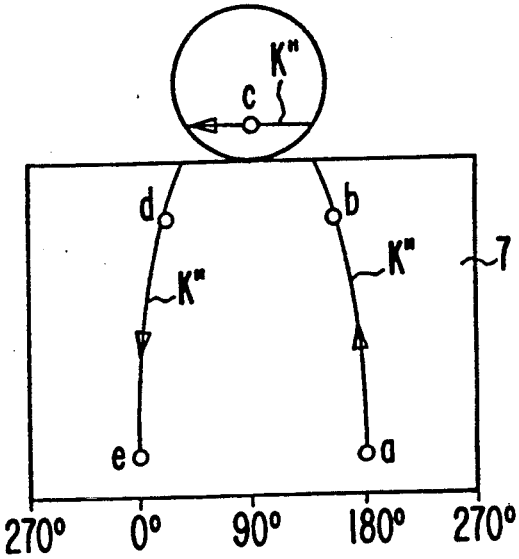
FIG. 9 is a developed view of a bottle in the manner of FIG. 5 showing the path of the jet impact points produced by the nozzle shaft of FIG. 8.

FIGS. 8 and 9 show a further embodiment which is a variation on the arrangement of FIGS. 6 and 7. A bore 26 in the nozzle shaft 22 has a larger angle $\alpha$ than in FIG. 6, i.e., one which is closer to 90°. The path K'' of the spray-jet impact points in this case is somewhat slenderer than the curve K' of FIG. 7 and reaches higher. The middle part of the curve passes across the bottle bottom. Comparison of FIGS. 7 and 9 shows how by varying the angles $\alpha$ of the bores, the spray condition can be changed in the bottles. Depending on bottle shape (slender and long or wide and short), the spray state can be matched to the particular requirements by adjusting angle $\alpha$.

Figure 10:
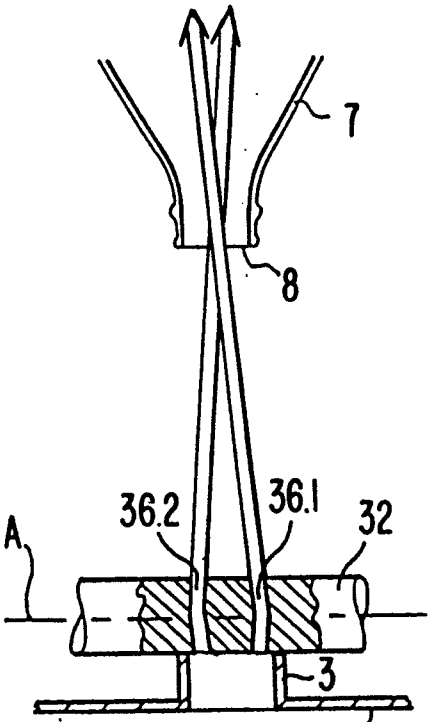
FIG. 10 is a sectional view of a nozzle shaft in accordance with the invention shown in the manner of FIG. 6 with two bores extending toward each other and obliquely spraying the same bottle.

FIG. 10 shows a further embodiment with a nozzle shaft 32 seen from the same direction as in FIGS. 6 and 8 and comprising two axially separated bores 36.1 and 36.2 on the axis of rotation A which slant symmetrically but in opposite directions. As shown by FIG. 10, the jets produced by these bores enter the same bottle 7. One jet sprays the left half of the bottle and the other jet the right half.

Figure 12:
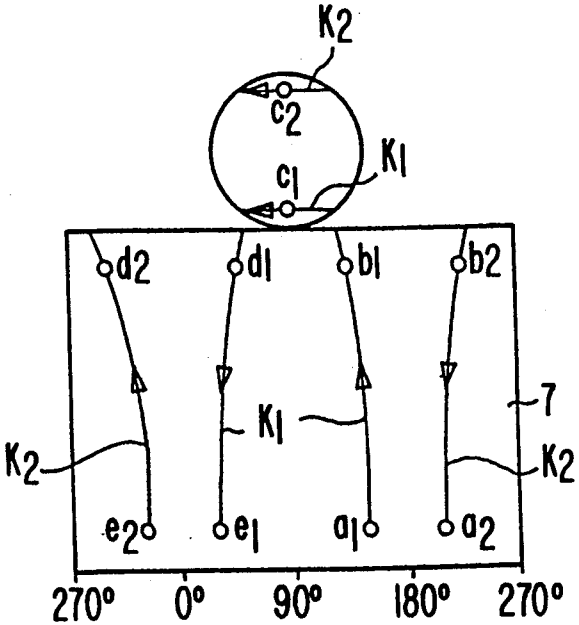
FIG. 12 is a developed view of a bottle in the manner of FIG. 9 showing the paths of the jet impact points produced by the nozzle shaft of FIGS. 10 and 11.

This is illustrated in FIG. 12 which shows the curving paths of the jet impact points of the developed bottle. The jets produced by the bore 36.1 follow the curve $K_1$ which is the locus of points including impact points $a_1$ through $e_1$. The jets from the bore 36.2 follow the curving path $K_2$ which runs precisely symmetrically to the bottle center plane passing through 0° and 180°.

This design provides even more intensive cleaning of the bottle, almost all inside bottle areas being cleaned directly by jets touching the bottle wall.

Figure 11:
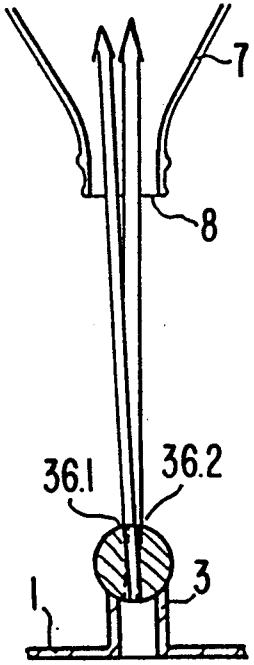
FIG. 11 is a transverse sectional view of the shaft of FIG. 10.

When employing this design with two bores 36.1 and 36.2, care must be taken that they be so mounted, as to their discharge angles relative to the axis of rotation A and their spacing on axis A, that they spray a bottle jointly. The jets cross in the zone of the bottle mouth 8 in the manner shown in FIG. 10. The jets are not allowed to touch because if they were, they would be strongly deflected. For that purpose and as shown by FIG. 11, care must be taken that they do not touch where they cross. Accordingly FIG. 11 shows that the bores 36.1 and 36.2 also are slightly slanted to each other in the plane perpendicular to the axis of rotation A (i.e., in the plane of the drawing of FIG. 11), so that they pass each other in the bottle mouth 8.

The especially intensive spray state shown by FIG. 12 can also be achieved by replacing the design of FIGS. 10 and 11 with two nozzle shafts designed, like that of FIG. 6 or 8, with only one bore. In that case, two nozzle shafts must be sequentially mounted along the path of advance of the bottle and spray in reversed slanting directions. This arrangement allows, for example, one nozzle shaft (FIG. 12) to spray along curve $K_1$ and the subsequent nozzle shaft to subsequently spray along the curve $K_2$.

The embodiments shown can be used in combination with other on one or more spray pipes, the nozzle shafts together comprising preferably several bores 16,26 or pairs of bores 36.1 and 36.2. Such nozzle shafts may be used in conventional bottle cleaning equipment wherein bottles are moved in long bottle baskets or in parallel on a large number of parallel bottle conveying paths.

As regards a single-track bottle-cleaning machine, one nozzle unit with a single bore or a single pair of bores will suffice.

Instead of mounting the nozzle unit in rotating unit to a spray pipe, it also may be stationary on it and be pivoted jointly, for instance to-and-fro.

What is claimed is:

1. A nozzle system for spraying internal surfaces of bottles moving along a path comprising spray pipe means having a delivery spout for supplying cleaning fluid under pressure, a nozzle unit on said spout mounted for rotation about an axis (A) generally perpendicular to said path in synchronization with the bottle advance for directing a stream of cleaning fluid from said spray pipe means into the bottles, said nozzle unit having a bore (16, 26, 36.1 and 36.2) therethrough, said bore having a central axis at each end which, at each surface of said nozzle unit, forms an acute angle with a plane perpendicular to said axis of rotation (A), said nozzle unit being rotated in only one direction so that the direction of fluid flow through each bore reverses with each complete rotation.

2. A nozzle system according to claim 1 wherein said nozzle unit (32) comprises two bores (36.1, 36.2) mutually spaced apart along said axis of rotation (A), said bores pointing to the mouth (8) of of the same bottle (7) at the same time and forming opposite angles relative to a plane perpendicular to said axis of rotation.

3. A nozzle system according to claim 2 wherein said bores (36.1, 36.2) are formed so that that the streams emanating therefrom are separated from each other at their crossing point in the vicinity of the bottle mouth (8).

4. A nozzle system according to claim 1 for use in bottle-cleaning equipment with bottles advancing in parallel in baskets, wherein said nozzle unit comprises an elongated nozzle shaft (2; 12; 22; 32) having a longitudinal axis mounted in parallel with said spray pipe (1) and comprising bores (6; 16; 26; 36.1, 36.2) for spraying fluid into all bottles (7).

* * * * *